US006785962B2

(12) United States Patent
Coleman

(10) Patent No.: US 6,785,962 B2
(45) Date of Patent: Sep. 7, 2004

(54) METHOD FOR PRODUCING A FULL FACE FABRICATED VEHICLE WHEEL

(75) Inventor: Alan Coleman, Southgate, MI (US)

(73) Assignee: Hayes Lemmerz International, Northville, MI (US)

( * ) Notice: Subject to any disclaimer, the term of this patent is extended or adjusted under 35 U.S.C. 154(b) by 95 days.

(21) Appl. No.: 10/154,000

(22) Filed: May 23, 2002

(65) Prior Publication Data

US 2003/0217466 A1 Nov. 27, 2003

(51) Int. Cl.[7] ..... B23P 17/00

(52) U.S. Cl. ..... 29/894.325; 29/894.323; 29/894.324; 301/63.106; 301/63.109

(58) Field of Search ..... 301/63.101, 63.103, 301/63.106, 63.109; 29/894.323, 894.324, 894.325

(56) References Cited

U.S. PATENT DOCUMENTS

| | | | | |
|---|---|---|---|---|
| 2,133,144 A | | 10/1938 | Johnson | |
| 3,129,496 A | * | 4/1964 | Cox | 29/894.324 |
| 3,222,765 A | * | 12/1965 | Parent et al. | 29/894.323 |
| 3,264,719 A | * | 8/1966 | Adams et al. | 29/894.324 |
| 4,280,426 A | | 7/1981 | Swan | |
| 5,295,304 A | | 3/1994 | Ashley, Jr. | |
| 5,345,676 A | | 9/1994 | Ashley, Jr. | |
| 5,579,578 A | * | 12/1996 | Ashley, Jr. | 29/894.322 |
| 5,634,271 A | * | 6/1997 | Lipper | 29/894.323 |
| 5,694,687 A | | 12/1997 | Coleman | |
| 5,740,609 A | * | 4/1998 | Jurus | 29/894.324 |
| 6,282,788 B1 | * | 9/2001 | Politi et al. | 29/894.323 |
| 6,473,967 B1 | * | 11/2002 | Coleman et al. | 29/894.322 |
| 6,546,629 B2 | * | 4/2003 | Politi | 29/894.322 |

FOREIGN PATENT DOCUMENTS

| | | | | |
|---|---|---|---|---|
| WO | WO 99/33594 | * | 7/1999 | B21D/53/30 |

* cited by examiner

*Primary Examiner*—Essama Omgba
(74) *Attorney, Agent, or Firm*—MacMillan, Sobanski & Todd, LLC

(57) ABSTRACT

This invention relates to an improved method for forming a full face fabricated vehicle wheel and includes the steps of: (a) providing a disc blank formed from a metal material; (b) subjecting the disc blank to a metal stamping operation to produce a partially formed non-bowl shaped full face wheel disc having at least one stamped pocket formed therein; (c) forming at least one decorative window in the partially formed full face wheel disc; (d) coining a back side of the window in the partially formed full face wheel disc; (e) trimming an outer edge of the partially formed full face wheel disc to a predetermined diameter; (f) forming a center hub hole in the partially formed full face wheel disc; (g) subjecting the partially formed full face wheel disc to one or more final metal forming operations to form at least one of an outer flange and a plurality of lug bolt mounting holes in the partially formed wheel disc so as to produce a finished full face wheel disc; and (h) securing the full face wheel disc to a preformed wheel rim to produce the finished full face fabricated vehicle wheel.

18 Claims, 12 Drawing Sheets

METHOD FOR PRODUCING A FULL FACE FABRICATED VEHICLE WHEEL

BACKGROUND OF THE INVENTION

This invention relates in general to vehicle wheels and in particular to an improved method for producing a full face fabricated vehicle wheel.

A conventional fabricated vehicle wheel is typically of a two-piece construction and includes an inner disc and an outer "full" rim. The disc can be cast, forged, or fabricated from steel, aluminum, or other alloys, and includes an inner annular wheel mounting portion and an outer annular portion. The wheel mounting portion defines an inboard mounting surface and includes a center pilot or hub hole, and a plurality of lug receiving holes formed therethrough for mounting the wheel to an axle of the vehicle. The rim is fabricated from steel, aluminum, or other alloys, and includes an inboard tire bead seat retaining flange, an inboard tire bead seat, an axially extending well, an outboard tire bead seat, and an outboard tire bead seat retaining flange. In some instances, a three-piece wheel construction having a mounting cup secured to the disc is used. In both types of constructions, the outer annular portion of the disc is secured to the rim by welding.

A full face fabricated vehicle wheel is distinguished from other types of fabricated wheels by having a one-piece wheel disc construction. In particular, the full face wheel includes a "full face" disc and a "partial" rim. The full face-disc can be formed cast, forged, or fabricated from steel, aluminum, or other alloys. The full face disc includes an inner annular wheel mounting portion and an outer annular portion which defines at least a portion of an outboard tire bead seat retaining flange of the wheel. The wheel mounting portion defines an inboard mounting surface and includes a center pilot or hub hole, and a plurality of lug receiving holes formed therethrough for mounting the wheel to an axle of the vehicle. The partial rim is fabricated from steel, aluminum, or other alloys, and includes an inboard tire bead seat retaining flange, an inboard tire bead seat, an axially extending well, and an outboard tire bead seat. In some instances, the outboard tire bead seat of the rim and the outer annular portion of the disc cooperate to form the outboard tire bead seat retaining flange of the full face wheel. In both types of constructions, the outboard tire bead seat of the rim is positioned adjacent the outer annular portion of the disc and a weld is applied to secure the rim and the disc together.

SUMMARY OF THE INVENTION

This invention relates to an improved method for forming a full face fabricated vehicle wheel and includes the steps of: (a) providing a disc blank formed from a metal material; (b) subjecting the disc blank to a metal stamping operation to produce a partially formed non-bowl shaped full face wheel disc having at least one stamped pocket formed therein; (c) forming at least one decorative window in the partially formed full face wheel disc; (d) coining a back side of the window in the partially formed full face wheel disc; (e) trimming an outer edge of the partially formed full face wheel disc to a predetermined diameter; (f) forming a center hub hole in the partially formed full face wheel disc; (g) subjecting the partially formed full face wheel disc to one or more final metal forming operations to form at least one of an outer flange and a plurality of lug bolt mounting holes in the partially formed wheel disc so as to produce a finished full face wheel disc; and (h) securing the full face wheel disc to a preformed wheel rim to produce the finished full face fabricated vehicle wheel.

Other advantages of this invention will become apparent to those skilled in the art from the following detailed description of the preferred embodiment, when read in light of the accompanying drawings.

DESCRIPTION OF THE PREFERRED EMBODIMENT

Figure 1:
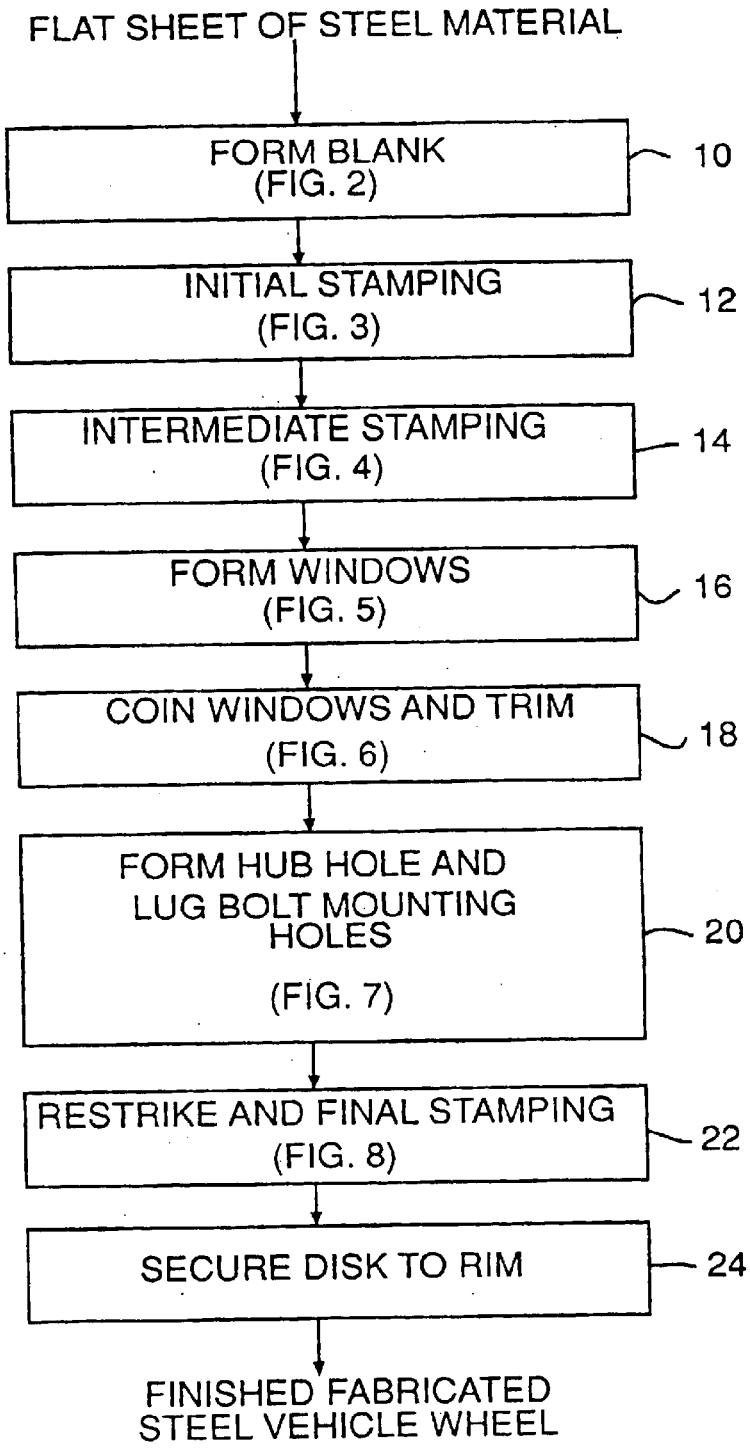
FIG. 1 (PRIOR ART)
FIG. 1 is a block diagram illustrating a prior art sequence of steps for producing a prior art full face fabricated vehicle wheel.
Figure 2:
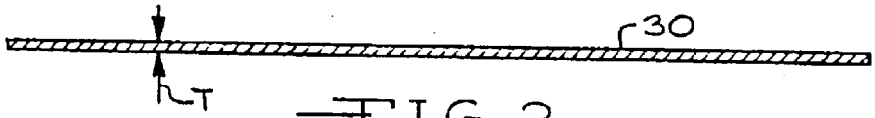
FIG. 2 PRIOR ART
FIG. 2 is a cross sectional view of a disc blank for use in producing the prior art full face fabricated vehicle wheel.
Figure 9:
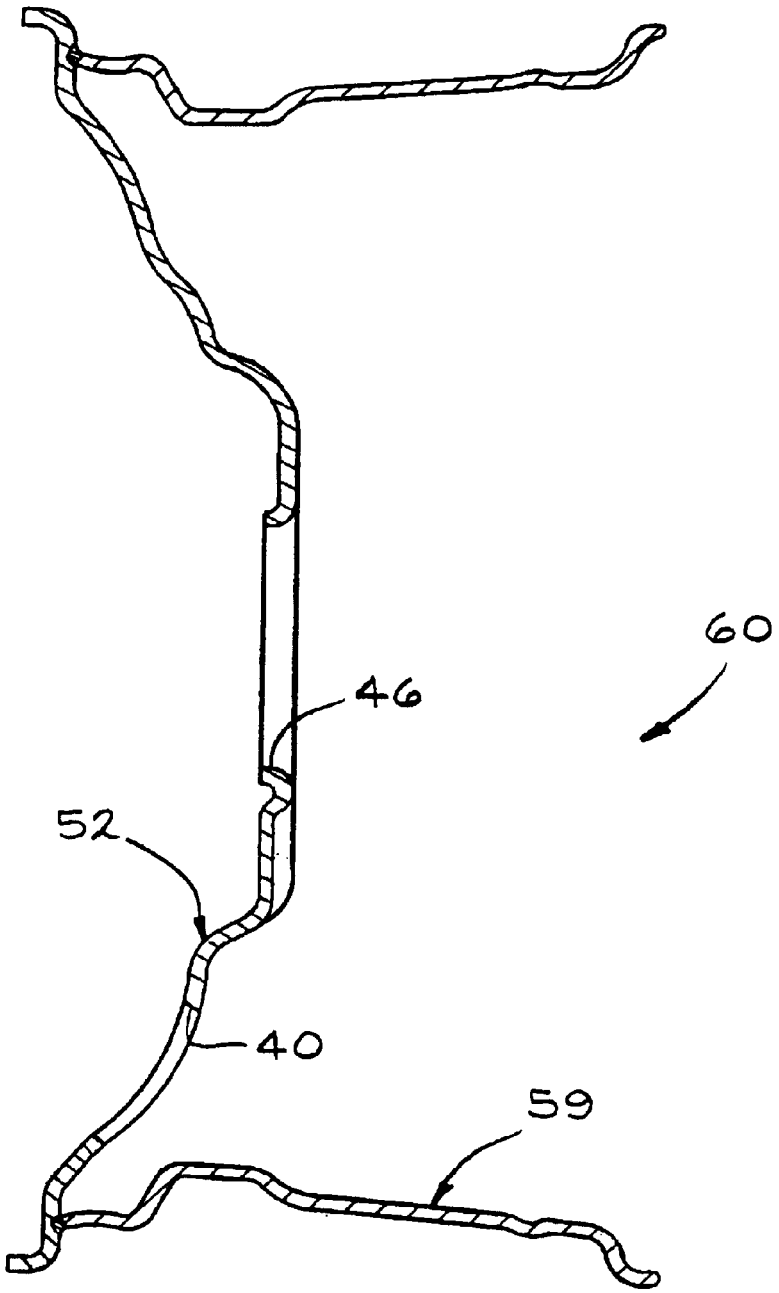
FIG. 9 (PRIOR ART)
FIG. 9 is a sectional view of a prior art full face fabricated vehicle wheel.

Referring now to the drawings, FIG. 1 illustrates a block diagram showing a prior art sequence of steps for producing a full face fabricated steel vehicle wheel, indicated generally at 60 in FIG. 9. Initially, in step 10, a flat sheet of steel material (not shown) is formed into a disc blank 30, shown in FIG. 2. The disc blank defines a generally uniform disc thickness T. Following this, the disc blank 30 is initially stamped in step 12 to produce a generally bowl shaped disc 32, shown in FIG. 3. The bowl-shaped disc 32 includes an outer annular portion 34, an inner annular wheel mounting portion 36 having a "flattened" bottom, and an intermediate portion 37 having a generally concave profile. In particular, during the initial stamping operation of step 12, the disc blank 30 is stamped to define a first predetermined axial distance A1 defined between an inner surface 34A of the outer annular portion 34 and an inner surface 36A of the inner mounting portion 36. Alternatively, in step 12, the disc blank 30 can be stamped to produce an intermediate portion 37 having a generally straight profile (not shown).

Figure 4:
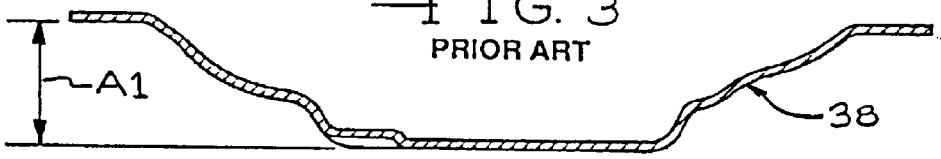
FIG. 4 PRIOR ART
FIG. 4 is a cross sectional view showing the intermediate stamping of the bowl shaped disc to produce a partially formed wheel disc.
Figure 5:
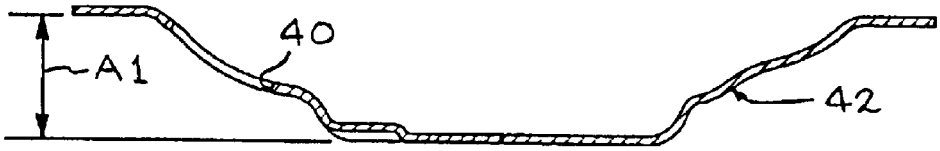
FIG. 5 PRIOR ART
FIG. 5 is a cross sectional view showing the forming of the windows in the partially formed wheel disc.
Figure 6:
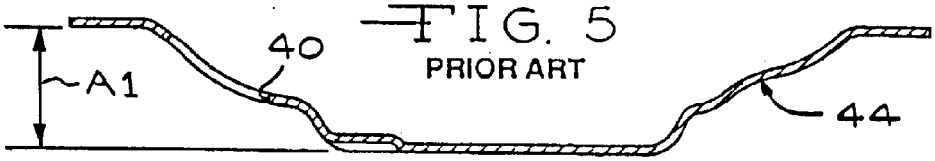
FIG. 6 PRIOR ART
FIG. 6 is a cross sectional view showing the trimming of the outer diameter of the partially formed wheel disc.
Figure 7:
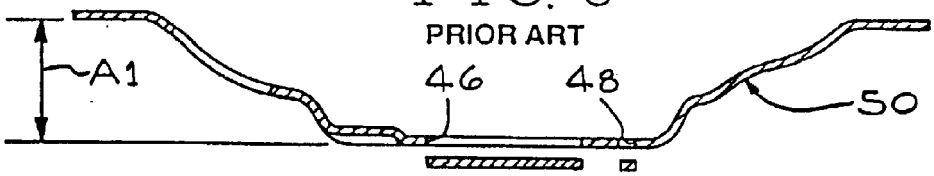
FIG. 7 PRIOR ART
FIG. 7 is a cross sectional view showing the forming of the hub hole and lug bolt mounting holes in the partially formed wheel disc.
Figure 8:
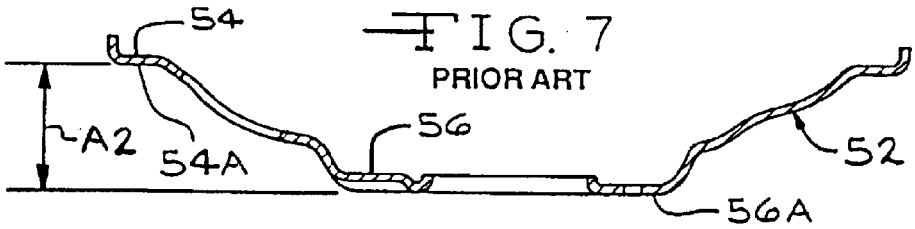
FIG. 8 PRIOR ART
FIG. 8 is a cross sectional view showing the final stamping of the partially formed wheel disc to produce a finished prior art full face fabricated wheel disc.

The bowl-shaped disc 32 is then stamped into a partially formed disc 38 having a predetermined profile, shown in FIG. 4, during step 14. Next, during step 16, a plurality of windows 40 (only one window illustrated in FIG. 5) are formed in the disc 38 to produce a partially formed disc 42. Following this, the windows 40 are coined and an outer edge of the partially formed disc 42 is trimmed to a predetermined diameter during step 18 to produce a partially formed disc 44 shown in FIG. 6. Next, in step 20, a center hub hole 46 and a plurality of lug bolt mounting holes 48 (only one hole 48 is illustrated) are formed in the disc 44 to produce a partially formed disc 50 shown in FIG. 7. Following this, the partially formed disc 50 is restriked and then subjected to a final stamping operation during step 22 to produce a finished full face steel wheel disc 52 shown in FIG. 8. During step 22, a second predetermined axial distance A2 is defined between an inner surface 54A of an outer annular portion 54 of the disc 50 and an inner surface 56A of an inner mounting portion 56 of the disc 52. In the illustrated embodiment, the second predetermined axial distance A2 is less than the first predetermined axial distance A1. Alternatively, the second predetermined axial distance A2 can be equal to the first predetermined axial distance A1. Following this, the full face disc 52 is secured to a partial steel wheel rim 59 during step 24 to produce the finished full face fabricated steel vehicle wheel 60 shown in FIG. 9.

Figure 3:
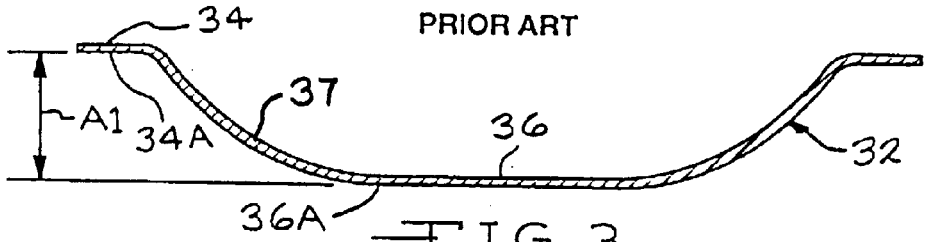
FIG. 3 PRIOR ART
FIG. 3 is a cross sectional view showing the initial stamping of the disc blank into a generally bowl shaped wheel disc.

Thus, in a conventional prior art full face steel wheel disc application, the initial stamping operation of step 12 is operative to form a bowl-shaped disc 32 having a finished part "tread" depth (i.e., the axial distances A1 and A2 are the same) or to form a bowl-shaped disc 32 having a deeper tread depth (i.e., the second axial distance A2 is greater than the first axial distance A1). Also, in a conventional prior art steel full face wheel disc application the initial stamping operation of step 12 is operative to form a bowl-shaped disc 32 wherein the intermediate portion 37 has a generally concave bowl wall surface (as shown in FIG. 3), or alternatively, a generally straight bowl wall surface (not shown). A generally similar sequence of steps can be used to produce a prior art full face fabricated aluminum vehicle wheel (not shown) having a prior art full face fabricated aluminum wheel disc (not shown).

Figure 10:
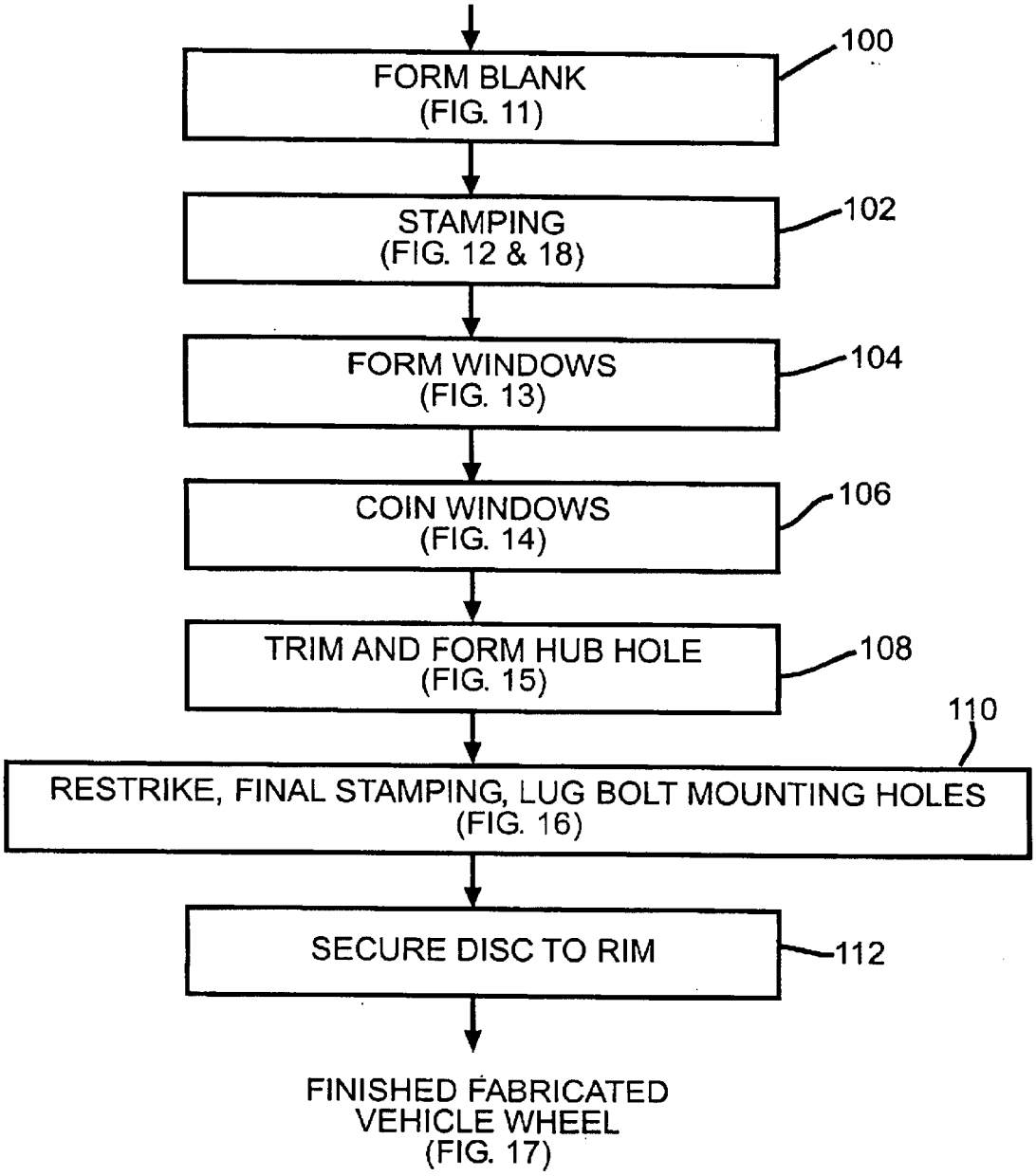
FIG. 10 is a block diagram illustrating a sequence of steps for producing a full face fabricated vehicle wheel in accordance with the present invention.

Referring now to FIG. 10, there is illustrated a block diagram showing a sequence of steps for producing a full face fabricated vehicle wheel in accordance with the present invention. The full face fabricated vehicle wheel produced according to this sequence of steps is illustrated as being a full face fabricated steel or aluminum vehicle wheel, indicated generally at 78 in FIG. 17. However, it will be appreciated that the present invention can be used in conjunction with other types of fabricated steel or aluminum vehicle wheels having a full face fabricated steel or aluminum wheel disc. For example, the vehicle wheel can be a "modular wheel" construction including a "partial" rim and a full face wheel disc (such as shown in U.S. Pat. No. 5,360,261 to Archibald et al.), the disclosure of this patent incorporated herein by reference.

Figure 11:
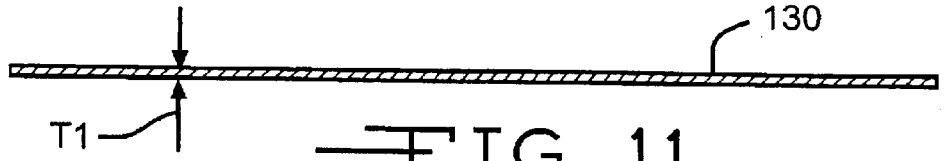
FIG. 11 is a cross sectional view of a disc blank for use in producing the full face fabricated vehicle wheel in accordance with this invention.

Turning to FIG. 10, a preferred sequence of steps for producing the full face fabricated vehicle wheel 78 of the present invention will be discussed. Initially, in step 100, a flat sheet of suitable metal material (not shown) is formed into a disc blank 130, shown in FIG. 11, by a metal forming operation. Preferably, the disc blank is formed by a stamping or blanking operation during step 100. The disc blank 130 defines a generally uniform disc thickness T1.

Figure 12:
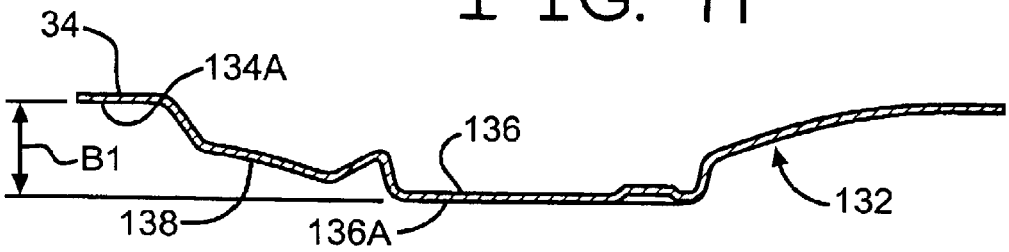
FIG. 12 is a cross sectional view showing the stamping of the disc blank into a partially formed wheel disc in accordance with this invention.
Figure 18:
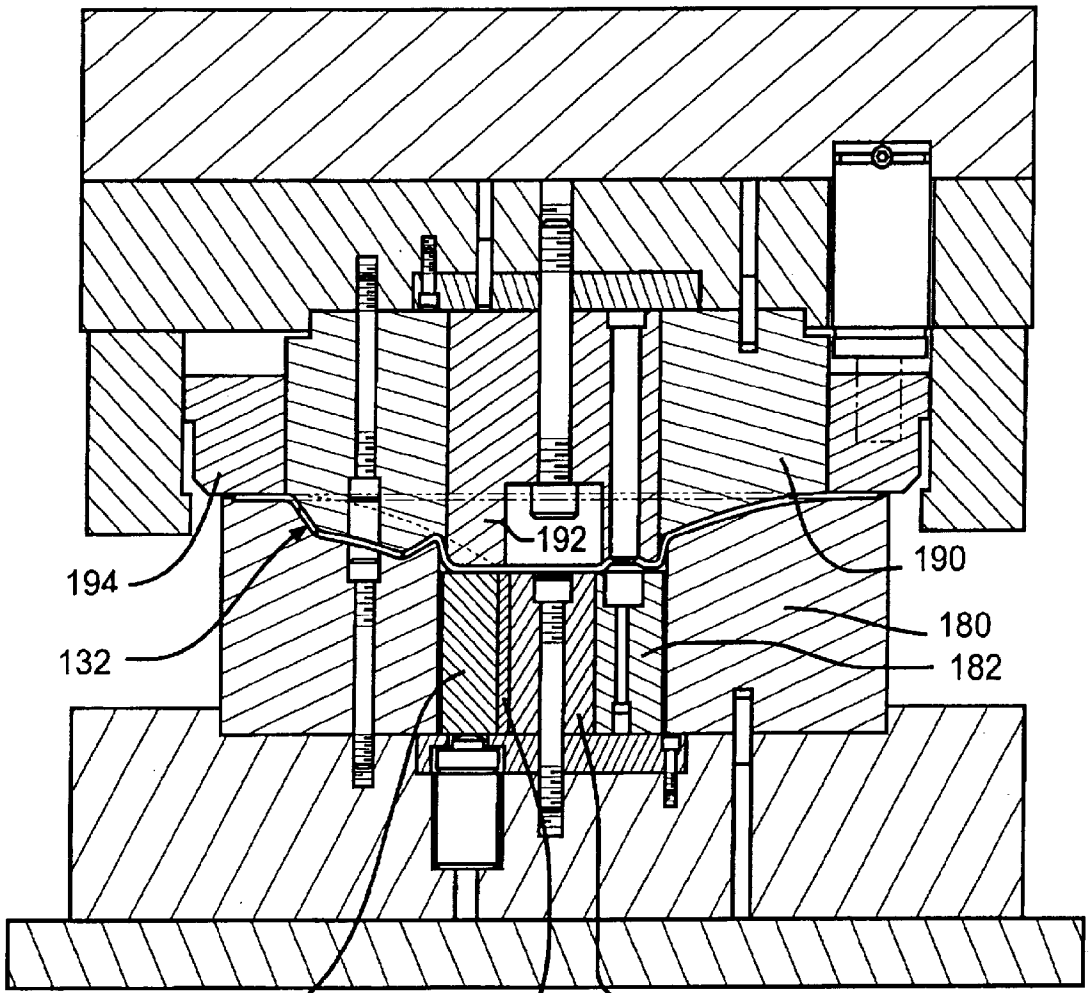
FIG. 18 is a sectional view showing the tooling for performing the stamping of the disc blank into the partially formed wheel disc illustrated in FIG. 12 in accordance with the present invention.
Figure 19:
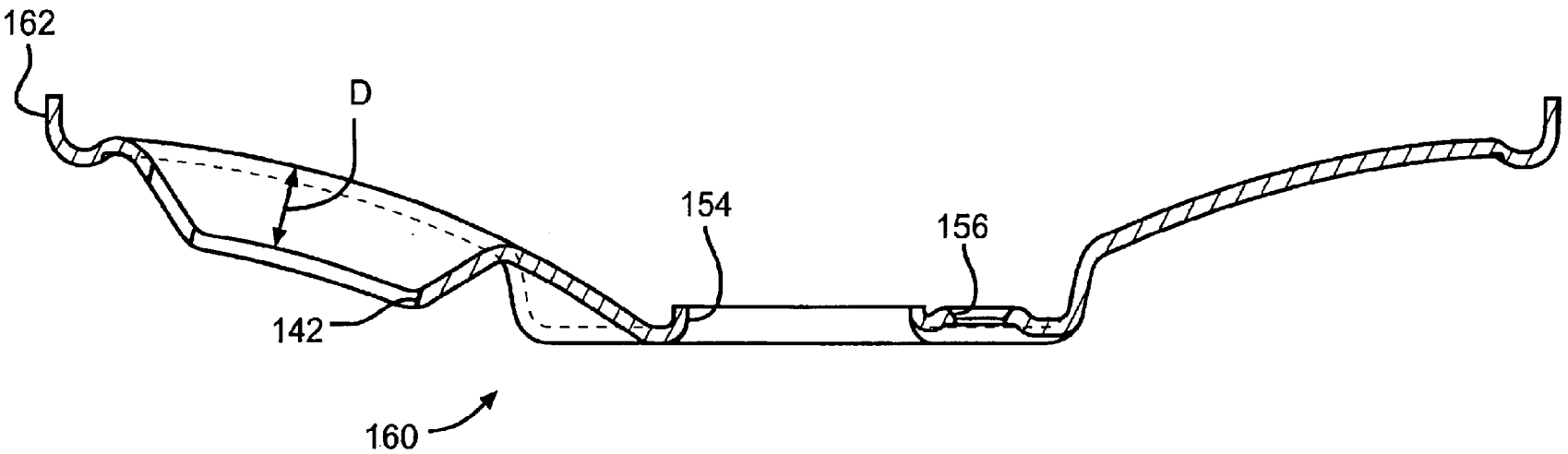
FIG. 19 is a sectional view similar to FIG. 12 showing the partially formed wheel disc after the stamping operation in accordance with the present invention.

Following this, the disc blank 130 is subjected to a metal forming operation in step 102 to produce a partially formed wheel disc 132, shown in FIGS. 12, 18 and 19, having fully formed stamped pockets. As shown therein, the partially formed wheel disc 132 includes an outer annular portion 134, an inner annular wheel mounting portion 136 having a generally flattened bottom, and an intermediate portion 138 having finish formed pockets which are later subjected to a metal forming operation which is effective to produce a plurality of decorative windows in the wheel disc as will be discussed below. In particular, the metal forming operation of step 102 is a stamping operation whereby the disc blank 130 is engaged by a plurality of dies (seven of such dies 180, 182, 184, 186, 188, 190 and 192 being illustrated in FIG. 18), and a binder ring or draw pad 194.

Figure 20:
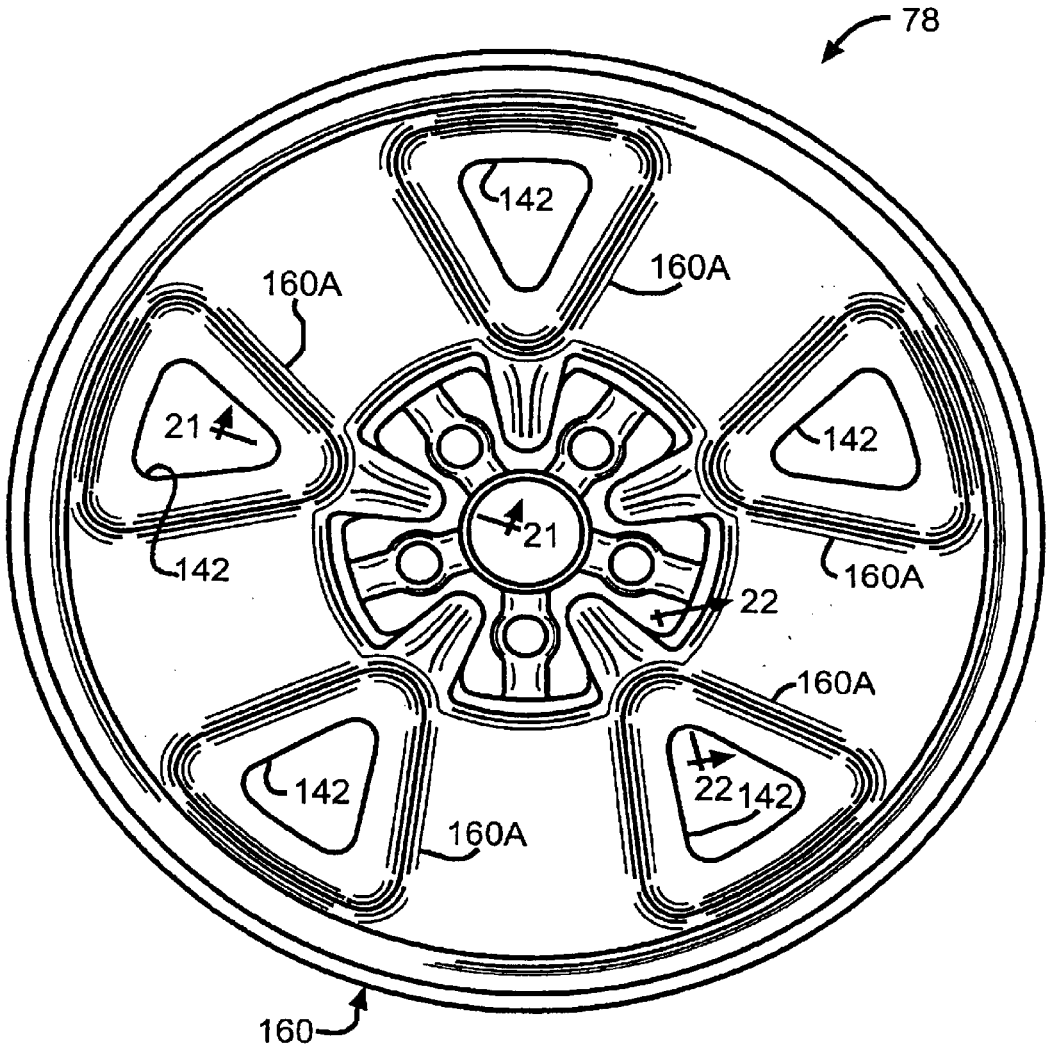
FIG. 20 is a view of the outwardly facing surface of the vehicle wheel produced in accordance with the sequence of steps of the present invention.
Figure 21:
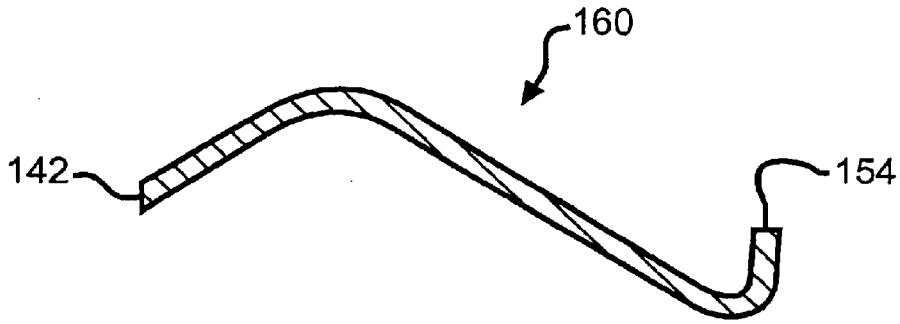
FIG. 21 is a sectional view taken along line 21—21 of FIG. 20.
Figure 22:
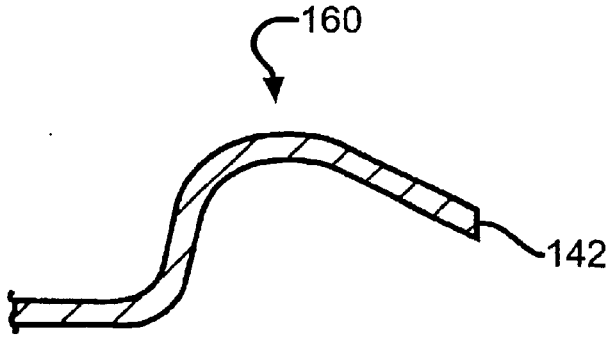
FIG. 22 is a sectional view taken along line 22—22 of FIG. 20.
Figure 23:
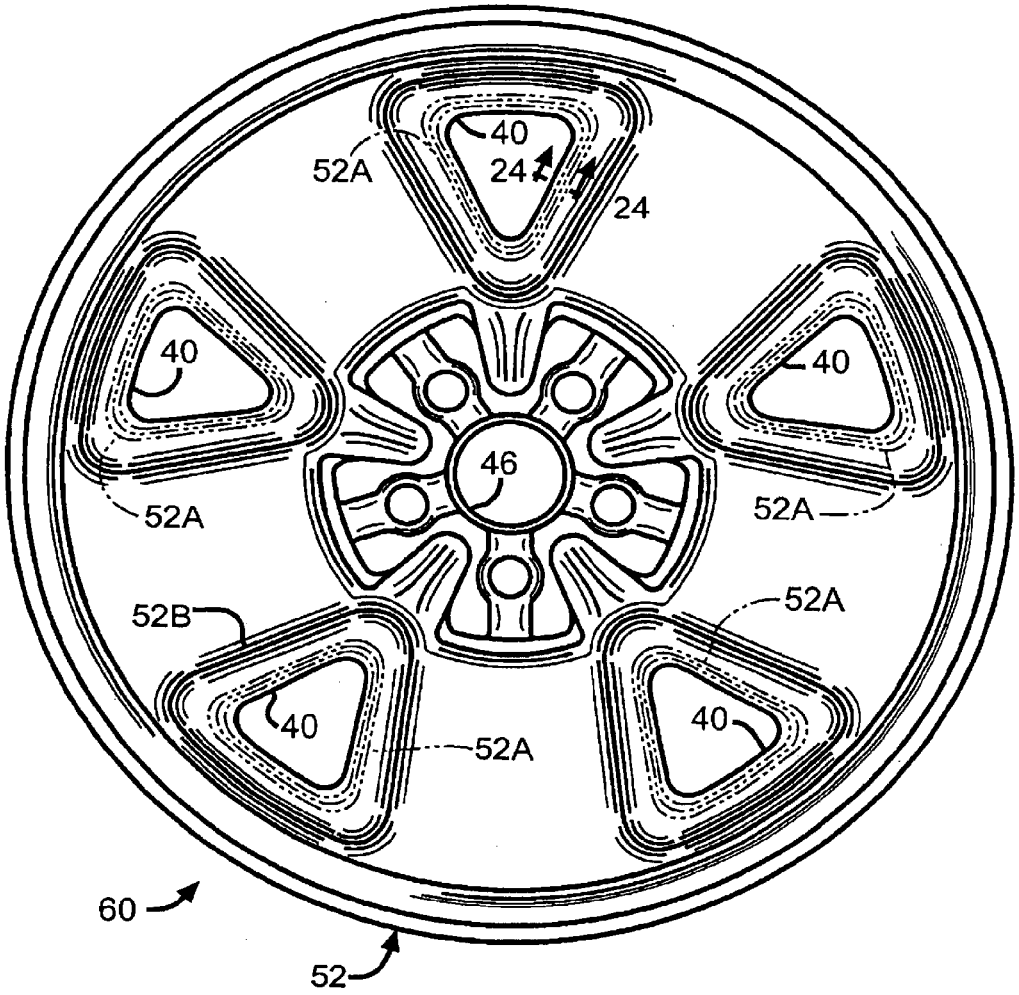
FIG. 23 PRIOR ART
FIG. 23 is a view of the outwardly facing surface of the prior art vehicle wheel produced in accordance with the prior art sequence of steps.
Figure 24:
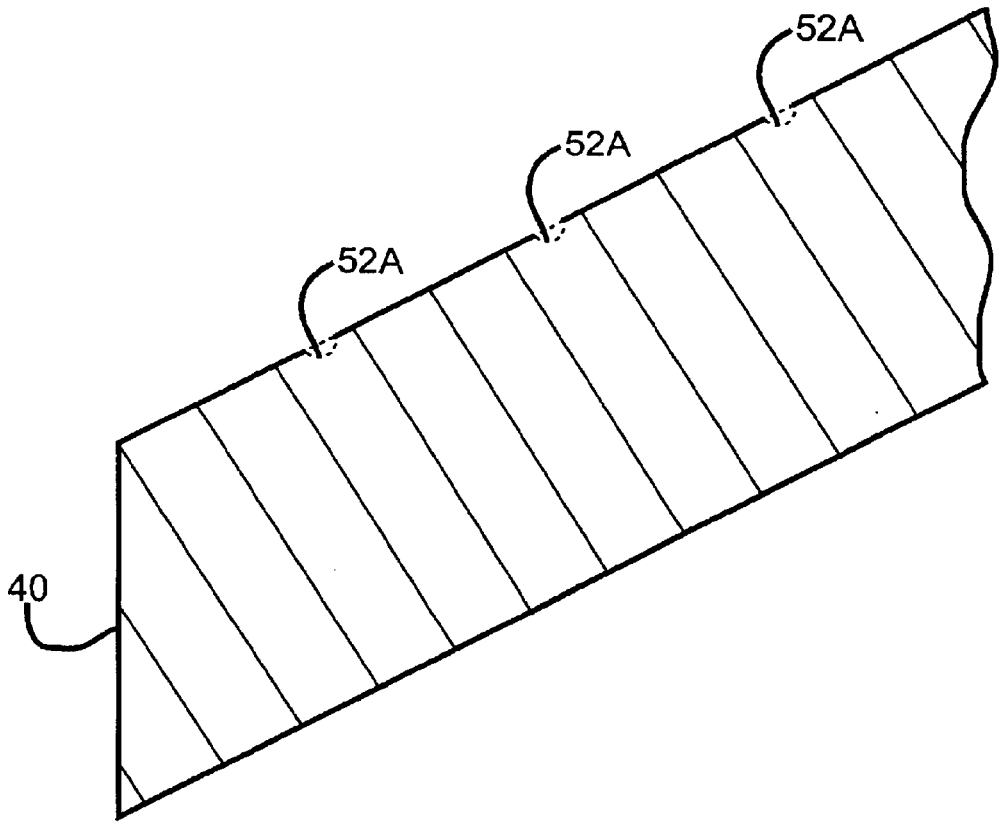
FIG. 24 PRIOR ART
FIG. 24 is a sectional view taken along line 24—24 of FIG. 23.

During step 102, the dies 180–192 are preferably operative to produce a partially formed wheel disc 132 having a first predetermined axial distance B1 defined between an inner surface 134A of the outer annular portion 134 and an inner surface 136A of the inner annular portion 136. As will be discussed below, by forming the partially formed disc 132 with the fully formed stamped pockets 138 directly from the flat blank 130 during step 102, the initial stamping operation 12 associated with the forming of the prior art bowl-shaped disc 32 is eliminated and the use of the binder ring 194 during step 102 is effective to produce a wheel disc 132 without any of the "tooling marks" on the outboard face of the disc 132 which are present on an outboard face of the associated prior art wheel disc 52. The term tooling marks as used herein refers to the visible marks on the outwardly facing surface of the full face wheel disc. This is shown by comparing the tooling marks, schematically indicated by dashed lines 52A on the outwardly facing surface of the prior art wheel disc 52 of the prior art vehicle wheel 60 shown in prior art FIG. 23 and produced according the sequence of steps disclosed in prior art FIG. 1, to the "clean" (i.e., no visible tooling marks or virtually non-existent tooling marks) on the outwardly facing surface of the wheel disc 160 of the vehicle wheel 78 produced in accordance with the sequence of steps disclosed in FIG. 10 of the present invention. It is noted that lines 52B shown on prior art FIG. 23 are shading lines for illustration purposes and are not tooling marks. Similarly, the lines 160A shown on FIG. 20 are shading lines for illustration purposes.

The binder ring 194 is needed for two purposes. First, due to the rather extreme depth of the pockets 138 (and the resulting windows 142 discussed below), the depth being illustrated in FIG. 19 by reference letter D, the binder ring 194 is effective to eliminate undulation or rippling of the material on the periphery of the disc 134 which is produced during step 102. The depth D being greater than around one-half inch and more preferably, the depth D being around one inch. In the prior art wheel, the depth of the windows is generally less than one-half inch. Secondly, the binder ring 194 allowed the flat disc blank 130 to be directly processed by only using a single stamping operation in step 102 to produce a partially formed/fully stamped wheel disc 132.

Figure 13:
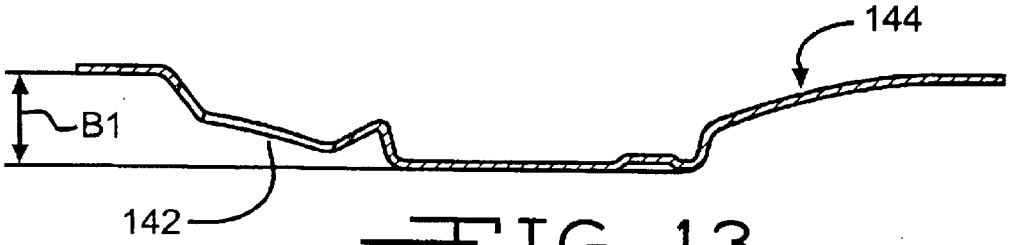
FIG. 13 is a cross sectional view showing the forming of the windows in the partially formed wheel disc in accordance with this invention.
Figure 14:
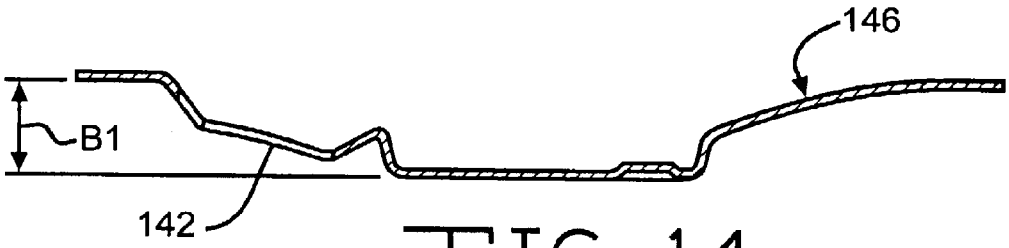
FIG. 14 is a cross sectional view showing the coining of the windows in accordance with the present invention.
Figure 15:
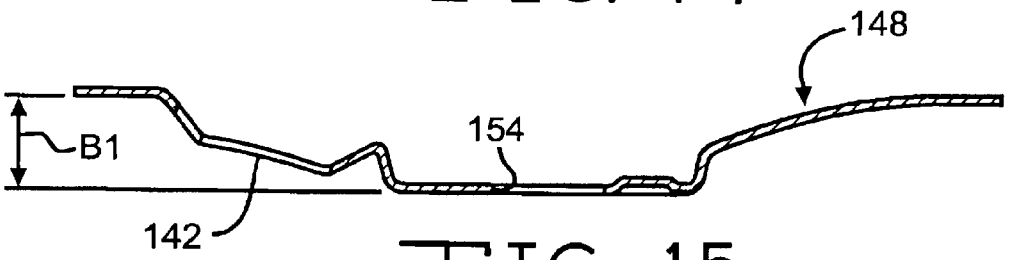
FIG. 15 is a cross sectional view showing the trimming of the outer diameter and the forming of the center hub hole of the partially formed wheel disc in accordance with this invention.

Next, during step 104, a plurality of decorative windows or openings 142 (only one of such windows 142 is illustrated in FIG. 13) are formed in the wheel disc 132 to produce a wheel disc 144. In step 106, the back side of the windows 142 are coined to produce a wheel disc 146. Following this, an outer edge of the wheel disc 146 is trimmed to a predetermined diameter and a center hub hole 154 is formed in the disc 146 to produce a disc 148 during step 108.

Figure 16:
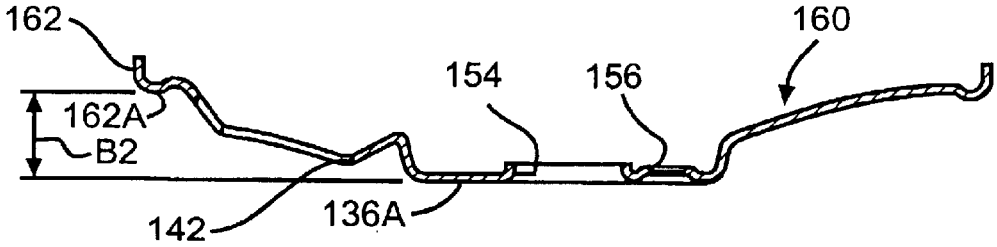
FIG. 16 is a cross sectional view showing the forming of the flange outer and inner diameters, the forming of the lug bolt mounting holes, and the forming of the fit up area to produce a finished full face fabricated wheel disc in accordance with this invention.
Figure 17:
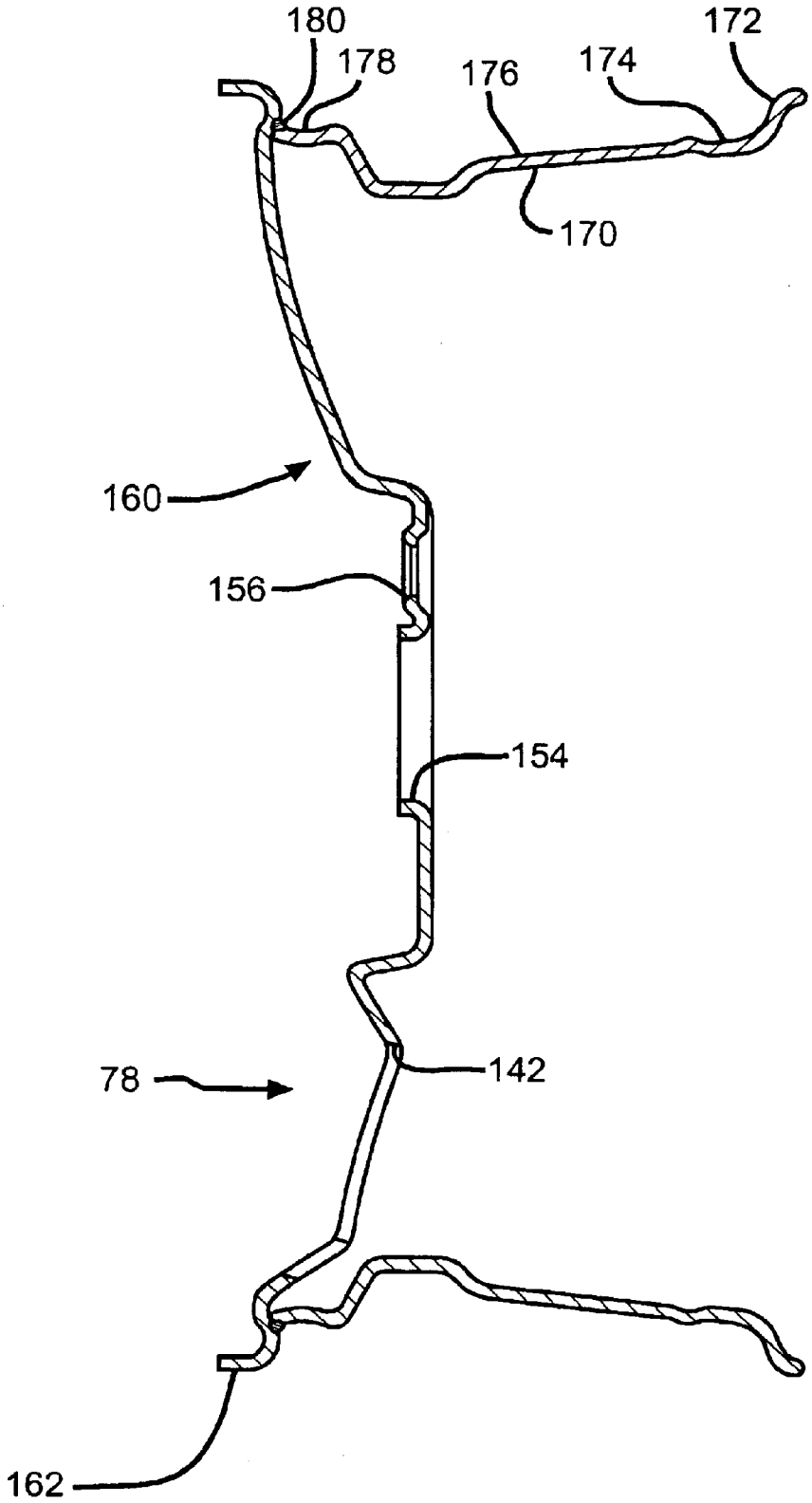
FIG. 17 is a sectional view of a full face fabricated vehicle wheel in produced in accordance with this invention.

In step 110, the disc 148 is restriked, the disc 148 is subjected to a final stamping operation to form a flange 162, and a plurality of lug bolt mounting holes 156 (only one hole 156 is illustrated in FIGS. 16 and 17) are formed in the disc 148 to produce a finished full face steel wheel disc 160 shown in FIGS. 16 and 17. The flange 162 of the disc 160 is operative to define an outboard tire bead seat retaining flange of the vehicle wheel 178. During step 110, a second predetermined axial distance B2 defined between an inner surface 162A of the flange 162 and the inner surface 136A of the inner annular portion 136. Preferably, the second axial distance B1 and the first axial distance B2 are approximately the same. Alternatively, the second axial distance B2 can be different from the first axial distance B1 if so desired.

Following this, the full face wheel disc 160 is secured to a partial wheel rim, indicated generally at 170 in FIG. 17, by suitable means, such as for example by a weld 180, to produce the finished full face fabricated steel vehicle wheel 78 shown in FIG. 17 of the present invention. The wheel rim 170 is preferably formed from the same material as the wheel disc 160, and includes an inboard tire bead seat retaining flange 172, an inboard tire bead seat 174, a well, 176, and an outboard tire bead seat 178. Alternatively, the wheel disc 160 and/or the wheel rim 170 can be formed from different and/or other materials if so desired.

One advantage of the present invention is that the partially formed/fully stamped wheel disc 132 is formed directly from the disc blank 130. As discussed above, the prior art method included the initial stamping operation of step 12 of the disc blank 30 into a generally bowl-shaped disc 32. Thus, the present invention eliminates a metal forming operation that was necessary in the prior art method. Also, the present invention produces a wheel disc 160 having none or virtually no tool marks on the outwardly facing surface thereof thereby producing a more cosmetically appealing vehicle wheel outwardly facing surface. The prior art wheel disc 52 included tool marks on the outwardly facing surface thereof of the wheel disc 52.

In accordance with the provisions of the patent statutes, the principle and mode of operation of this invention have been described and illustrated in its preferred embodiment. However, it must be understood that the invention may be practiced otherwise than as specifically explained and illustrated without departing from the scope or spirit of the attached claims.

What is claimed is:

1. A method for forming a full face fabricated vehicle wheel comprising the steps of:

(a) providing a disc blank formed from a metal material;

(b) subjecting the disc blank to a single metal stamping operation to produce a partially formed, stamped full face wheel disc including an outer annular portion, an annular wheel mounting portion having a generally flattened bottom, and an intermediate portion having finish formed pockets, the partially formed, stamped full face wheel disc having a predetermined axial distance defined between an inner surface of the outer annular portion and an inner surface of the inner annular portion;

(c) forming at least one decorative window in the partially formed, stamped full face wheel disc;

(d) coining a back side of the window in the partially formed, stamped full face wheel disc;

(e) trimming an outer edge of the partially formed, stamped full face wheel disc to a predetermined diameter;

(f) forming a center hub hole in the partially formed, stamped full face wheel disc;

(g) subjecting the partially formed, stamped full face wheel disc to one or more final metal forming operations to form at least one of an outer flange and a plurality of lug bolt mounting holes in the partially formed, stamped wheel disc so as to produce a finished full face wheel disc; and (h) securing the full face wheel disc to a preformed wheel rim to produce a finished full face fabricated vehicle wheel.

2. The method according to claim 1 wherein in the step (b) said predetermined axial distance is a first predetermined axial distance and in the step (g) a second predetermined axial distance is defined between an inner surface of the flange and the inner surface of the inner annular portion, the second axial distance and the first axial distance being approximately the same.

3. The method according to claim 1 wherein in the step (b) said predetermined distance is a first predetermined axial distance and in the step (g) a second predetermined axial distance is defined between an inner surface of the flange and the inner surface of the inner annular portion, the second axial distance and the first axial distance being different.

4. The method according to claim 1 wherein in the step (b) the partially formed, stamped full face wheel disc is formed with virtually non-existent tooling marks on an outwardly facing surface thereof.

5. The method according to claim 1 wherein in the step (b) the said finished formed pockets are formed with a depth greater than at least one-half inch.

6. The method according to claim 1 wherein in the step (b) the said finished formed pockets are formed with a depth greater than one inch.

7. The method according to claim 1 wherein in the step (a) the metal blank is formed from steel.

8. The method according to claim 1 wherein in the step (a) the metal blank is formed from aluminum.

9. A method for forming a full face fabricated steel vehicle wheel comprising the steps of:

(a) providing a disc blank formed from a steel material;

(b) subjecting the disc blank to a single metal stamping operation to produce a partially formed, stamped full face wheel disc including an outer annular portion, an annular wheel mounting portion having a generally flattened bottom, and an intermediate portion having finish formed pockets, the partially formed, stamped full face wheel disc having a predetermined axial distance defined between an inner surface of the outer annular portion and an inner surface of the inner annular portion;

(c) subjecting the partially formed, stamped full face wheel disc to one or more metal forming operations to form at least one of a center hub hole, at least one decorative window, an outer flange, and a plurality of lug bolt mounting holes in the partially formed, stamped wheel disc so as to produce a finished full face wheel disc; and (d) securing the finished full face wheel disc to a preformed wheel rim to produce a finished full face fabricated vehicle wheel.

10. The method according to claim 9 wherein in the step (b) said predetermined axial distance is a first predetermined axial distance and in the step (c) a second predetermined axial distance is defined between an inner surface of the flange and the inner surface of the inner annular portion, the second axial distance and the first axial distance being approximately the same.

11. The method according to claim 9 wherein in the step (b) said predetermined axial distance is a first predetermined axial distance and in the step (c) a second predetermined axial distance is defined between an inner surface of the flange and the inner surface of the inner annular portion, the second axial distance and the first axial distance being different.

12. The method according to claim 9 wherein in the step (b) the partially formed stamped face wheel disc is formed with virtually non-existent tooling marks on an outboard face thereof.

13. The method according to claim 9 wherein in the step (b) the said finish formed pockets are formed with a depth greater than at least one-half inch.

14. The method according to claim 9 wherein in the step (b) the said finish formed pockets are formed with a depth greater than one inch.

15. The method according to claim 9 wherein in the step (a) the metal blank is formed from steel.

16. The method according to claim 9 wherein in the step (a) the metal blank is formed from aluminum.

17. A method for forming a full face fabricated steel vehicle wheel comprising the steps of:

(a) providing a disc blank formed from a steel material;

(b) subjecting the disc blank to a metal stamping operation to produce a partially formed, stamped full face wheel disc including an outer annular portion, an annular wheel mounting portion having a generally flattened bottom, and an intermediate portion having finish formed pockets, the partially formed, stamped full face wheel disc having a predetermined axial distance defined between an inner surface of the outer annular portion and an inner surface of the inner annular portion;

(c) forming a plurality of decorative windows in the partially formed, stamped full face wheel disc;

(d) coining a back side of the windows in the partially formed, stamped full face wheel disc;

(e) trimming an outer edge of the partially formed, stamped full face wheel disc to a predetermined diameter;

(f) forming a center hub hole in the partially formed, stamped full face wheel disc;

(g) subjecting the partially formed, stamped full face wheel disc to one or more final metal forming operations to form an outer flange and a plurality of lug bolt mounting holes in the partially formed, stamped wheel disc so as to produce a finished full face wheel disc; and (h) securing the finished full face steel wheel disc to a preformed steel wheel rim to produce a finished full face fabricated steel vehicle wheel.

18. The method according to claim 17 wherein in the step (b) each of the fully stamped pockets is formed with a depth greater than at least one-half inch.

* * * * *

UNITED STATES PATENT AND TRADEMARK OFFICE

CERTIFICATE OF CORRECTION

PATENT NO. : 6,785,962 B2
DATED : September 7, 2004
INVENTOR(S) : Alan Coleman

It is certified that error appears in the above-identified patent and that said Letters Patent is hereby corrected as shown below:

Column 6,
Line 40, after "the" insert -- finished --.

Column 7,
Line 3, after "fabricated" delete "steel";
Line 5, delete "steel" and insert -- metal --;
Line 42, after "partially formed" insert a -- , --;

Column 8,
Line 12, after "a" insert -- single --.
Line 44, delete "the fully stamped" and insert -- said finished formed --.

Signed and Sealed this

Seventh Day of December, 2004

JON W. DUDAS
*Director of the United States Patent and Trademark Office*